United States Patent [19]

Krings

[11] 4,372,709

[45] Feb. 8, 1983

[54] EXCAVATION OR TRENCHING PLATE

[76] Inventor: Josef Krings, Hans-Boeckler-Str. 23, D-5138 Heinsberg-Oberbruch, Fed. Rep. of Germany

[21] Appl. No.: 129,326

[22] Filed: Mar. 11, 1980

[30] Foreign Application Priority Data

Jul. 16, 1979 [DE] Fed. Rep. of Germany ... 7920284[U]

[51] Int. Cl.[3] ..... E02D 17/00

[52] U.S. Cl. ..... 405/282; 405/272

[58] Field of Search ..... 405/14, 272, 279, 282, 405/283, 284, 285; 52/227, 579, 585

[56] References Cited

U.S. PATENT DOCUMENTS

| | | | |
|---|---|---|---|
| 1,441,970 | 1/1923 | D'Erville | 52/227 |
| 2,387,659 | 10/1945 | Hafsos | 52/227 |
| 2,919,133 | 12/1959 | Eggers | 52/227 X |
| 3,750,409 | 8/1973 | Orfei | 405/283 |
| 3,869,867 | 3/1975 | Krings | 405/282 |
| 4,259,028 | 3/1981 | Cook | 405/282 |

FOREIGN PATENT DOCUMENTS

| | | | |
|---|---|---|---|
| 2230395 | 1/1974 | Fed. Rep. of Germany | 405/282 |

*Primary Examiner*—David H. Corbin

*Attorney, Agent, or Firm*—Diller, Ramik & Wight

[57] ABSTRACT

This disclosure relates to an excavation or trenching plate which includes one or more panels formed by a plurality of generally C-shaped vertically oriented beams collectively defining a plurality of side-by-side vertical chambers endmost ones of which open in opposite sidewise directions through associated grooves, upper and lower generally horizontal beams also of generally C-shaped configuration spanning the upper and lower ends of the vertical beams with the horizontal beams likewise having horizontal channels opening endwise in opposite directions through horizontal grooves, and tie bars extending horizontally and vertically through the various beams and being accessible through channels of the endmost vertical beams and upper and lower beams for retaining the beams in assembled relationship.

19 Claims, 6 Drawing Figures

Fig. 1
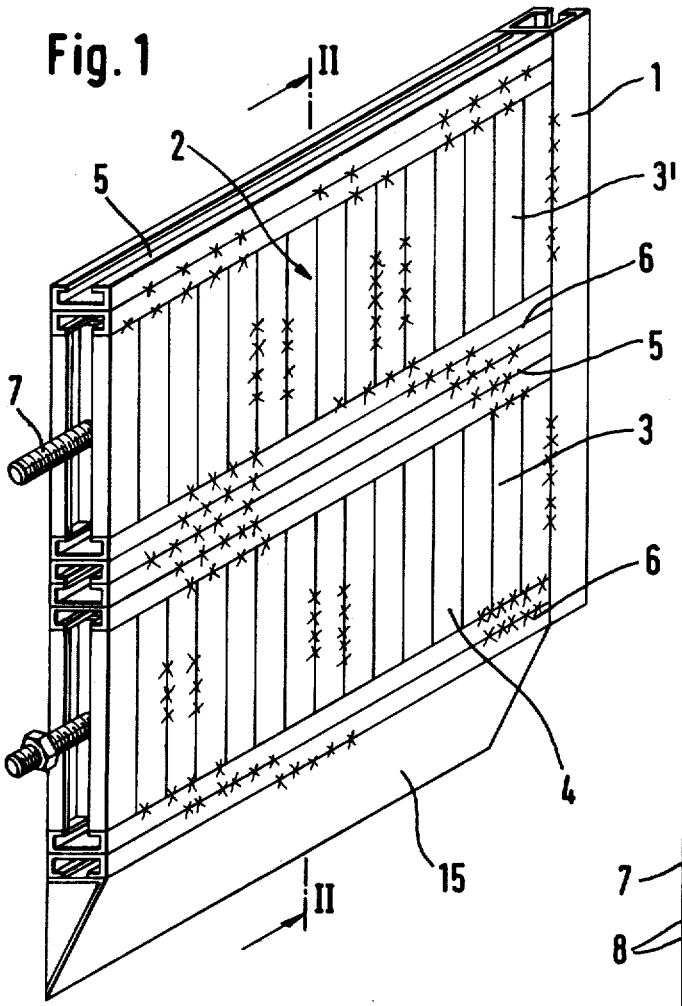
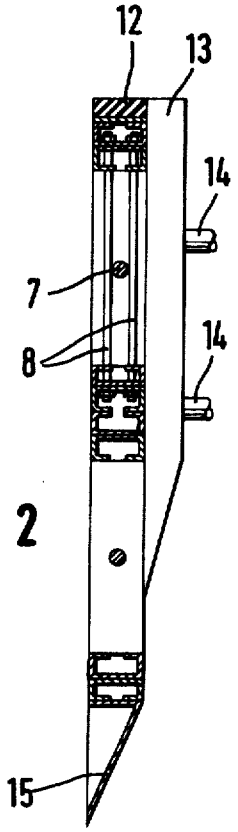
Fig. 2

EXCAVATION OR TRENCHING PLATE

The present invention is directed to a trenching, excavation or like plate or support which is formed of a plurality of vertically oriented beams collectively defining a plurality of side-by-side vertical chambers, the vertically oriented beams preferably being of a C-shaped transverse cross-section, and the latter beams being utilized together and connected to upper and lower horizontal beams also preferably of a generally C-shaped or like boxed transverse cross-sectional configuration.

Excavation or trenching plates or supports of the type to which this invention is directed are known and generally consist of vertical or horizontal steel sections or steel sheet sections which are in intimate relationship one next to the other and are mutually welded together. Such plates are generally formed from a plurality of U-shaped, C-shaped or similar box-shaped profiles, and are generally enclosed by a frame section (German Patent No. 19 56 337).

Excavation or trenching plates of the type just described have the disadvantage of requiring long weld seams or alternately short welding seams and associated heating zones, both of which require expert welders and involve a relatively laborious production process.

A further development in such excavation plates involves the formation of a panel from shaped or profiled beams or sections which were covered on both sides by metal plating or metal sheeting. Generally the metal sheets were connected to the internal framing or beams utilizing spot welds or light seam welding. However, even though these excavation or trenching plates have proved quite practical, they again require relatively expensive manufacturing facilities, expert personnel and extensive storage areas.

There was therefore the need to provide a simple design of excavation or trenching plates or supports which would minimize welding, increase production time and could be accomplished with less skilled labor than in the past. The present invention accomplishes the latter by forming a panel from a plurality of box-section beams, such as C-shaped beams which are disposed in generally vertical relationship and having like beams secured to upper and lower ends of the vertical beams and then interconnecting all of these with horizontal and vertical tie rods thus totally eliminating or minimizing welding.

In further accordance with this invention the uppermost and lowermost horizontal beams and the endmost of the vertical beams have channels which open through grooves outwardly thus exposing ends of the tie bars for securing nuts thereto.

Still another object of this invention is to provide a novel excavation support or plate of the type aforesaid wherein identical plates are mounted one on top of the other in generally coplanar relationship and these are interconnected by vertical tie bars and associated nuts, and whether formed as a single panel or a set of multiple panels which are unitized by tie bars, the same might be bounded by C-beams, I-beams, or like box beams for reinforcing and interconnecting functions.

IN THE DRAWINGS:

With the above and other objects in view that will hereinafter appear, the nature of the invention will be more clearly understood by reference to the following detailed description, the appended claims and the several views illustrated in the accompanying drawings.

FIG. 1 is a perspective view with the left side in cross-section of a novel excavation or trenching support or plate constructed in accordance with this invention, and illustrates vertical and horizontal C-shaped beams, each having an individual channel and groove with tie bars disposed in horizontal relationship for interconnecting the vertical beams to each other.

FIG. 2 is a sectional view taken generally along the line of II—II of FIG. 1, and illustrates details of the excavation support or plate.

Figure 3:
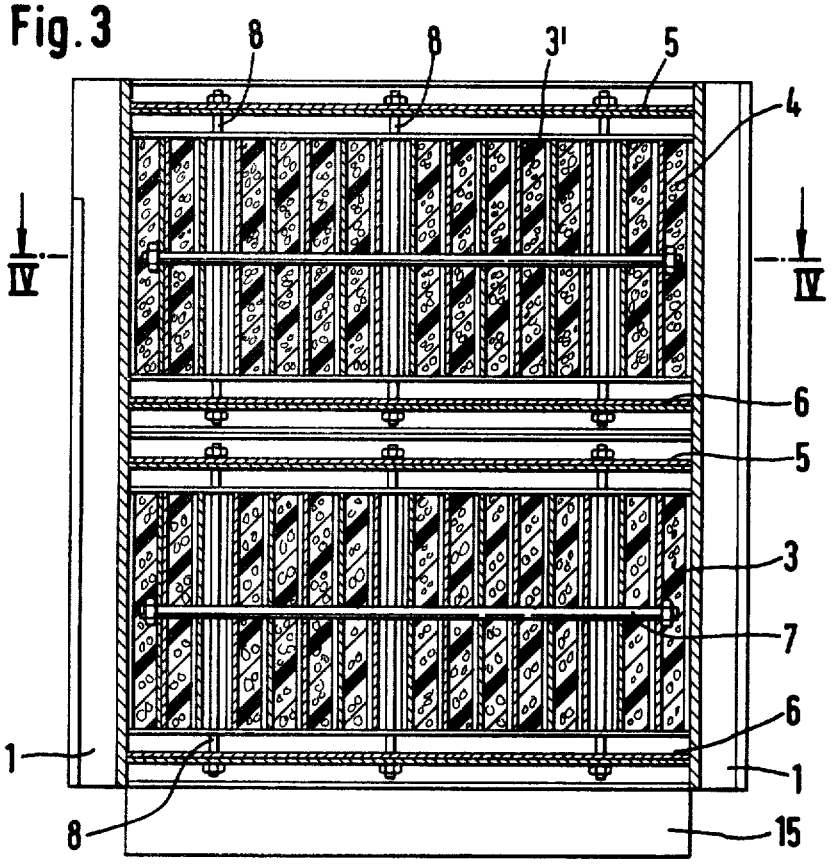
FIG. 3 is a cross-sectional view taken generally along the line of III—III of FIG. 4, and illustrates a vertical section through the excavation support of FIG. 1 and specifically the manner in which the tie bars are associated with various ones of the vertical and horizontal beams.
Figure 4:
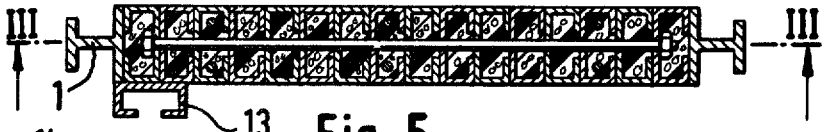
FIG. 4 is a cross-sectional view taken generally along the line of IV—IV of FIG. 3, and illustrates one of the horizontal tie bars unitizing the vertical beams with endmost ones of the vertical beams being capped or closed by I-shaped or H-shaped beams.
Figure 5:
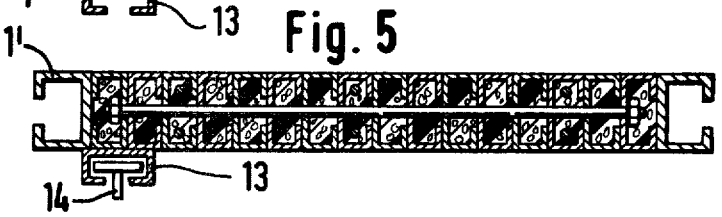
FIG. 5 is a sectional view similar to FIG. 4, and illustrates another excavation plate with generally C-shaped end beams or guide beams, and another guide beam for transverse spreaders or trenching supports.

Reference is made to FIGS. 1-4 of the drawings in which a novel excavation or trenching support or plate constructed in accordance with this invention is designated by the reference numeral 2 which is in part defined by vertical end beams one of a C-shape, I-shape, H-shaped or like transverse cross-sectional configuration. Sandwiched between the end or guidance beams 1,1 are a plurality of contiguous generally vertical oriented C-shaped or like contoured box beams 4 which in FIG. 4 is shown to have a generally C-shaped configuration each including a vertical chamber (unnumbered) and a vertical groove (also unnumbered) with the grooves of the endmost chambers opening endwise or sidewise in opposite directions. A pair of upper generally horizontally disposed beams 5 and a pair of lower generally horizontally disposed beams 6 sandwiched therebetween the vertical beams 4 and defined therewith an upper panel set 3' and a lower panel set 3 of the overall excavation or trenching support or panel 2. The upper horizontally disposed beams 5 and the lower horizontally disposed beams 6 have the bight portions (unnumbered) thereof welded to each other and the end beam of each pair of horizontal beams 5,6 is disposed with its chamber (unnumbered) opening outwardly through its associated channel (unnumbered).

Tie bar means 7 having threaded end portions (unnumbered) which receive nuts (also unnumbered) pass through openings (unnumbered) which are in alignment and are formed in the bight portions (unnumbered) of the vertical beams 4. By tightening the nuts (unnumbered) associated with the tie bar means or tie bars 7, the vertical beams 4 of both panel sets 3,3' are intimately held against each other under compressive forces, as is most readily apparent in FIG. 3. Likewise, aligned openings (unnumbered) are formed in the bight or bight portions of the beams 5,6, as is most evident in FIG. 3, and tie bar means 8 pass therethrough and through selected ones of the chambers of the vertical beams 4 and receive upon threaded end portions (unnumbered) thereof respective nuts (also unnumbered). In this manner the tie bar means 8 compressively clamp together the vertical beams 4 of the upper panel set 3' and the lower panel set 3, in the manner most evident from FIG. 3.

Figure 6:
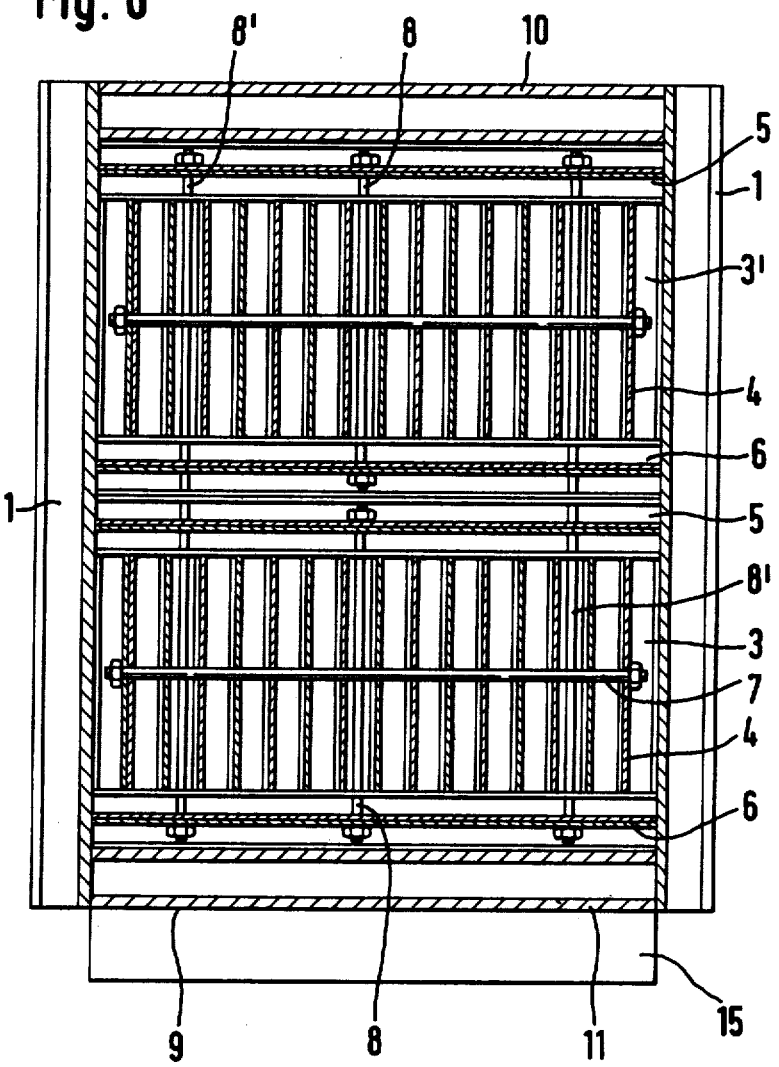
FIG. 6 is a vertical, longitudinal sectional view of another excavation plate similar to FIG. 3 and illustrates the manner in which vertical tie rods extend through upper and lower panels and interconnect the same into a single unitized excavation or support.

Reference is made to FIG. 6 wherein an excavation panel which is basically the duplicate of the excavation panel 2 of FIG. 1 is illustrated and includes additional vertical tie bar means 8' which compressively connect together the upper and lower panel sets 3',3, respectively. However, in either embodiment (FIGS. 3 and 6) the bights of the horizontal beams 5,6 need not be welded to each other since these beams are held in intimate relationship by the vertical bar means 8 and/or 8' associated therewith. Obviously, the number and the thickness of the tie rods and the associated bars, beams and channels depend upon required static relationships, particularly the size of panel desired and the use to which it is designed. Additionally, any of the excavation supports 2 can be mounted one on top of the other by welding or by being interconnected by another set of vertical tie rods. As is best illustrated in FIGS. 3-6, both the uppermost C-shaped beam of the upper horizontal beams 5 and the lowermost horizontal beams 6 open outwardly as do the channels and grooves of the endmost vertical beams 4 such that the tie rods 8,8' and 7, respectively, are readily accessible from the exterior of the overall excavating panel 2 such that the tie bars 7,8,8' can be installed in the respective openings of these beams and the nuts relatively easily applied to the threaded end portions of the tie bars from the exterior of the overall panel sets 3,3' prior, of course, to the guidance or end beams 1,1' being welded or otherwise secured thereto.

Referring once again to FIGS. 1 and 3 of the drawings, the panel sets 3,3' are connected to each other by welding thereto the guide bars or beams 1,1' (FIGS. 4 and 5), the latter being of an I-shape, C-shape or H-shaped configuration. In this manner, the overall excavation panel support 2 of FIGS. 1 and 3 is formed of two panel sets 3,3' held together by the end or guide beams 1,1'. This is to be distinguished from the embodiment of the invention shown in FIG. 6 wherein the end beams or guide beams 1,1 might be detachably connected (not shown) to the panel set 3,3' since the latter are interconnected by the vertical tie bar means 8'. However, even in the embodiment shown in FIG. 6 the end or guidance beams 1,1 may be additionally be welded to appropriate beams 4,5, 6 of the panel sets 3,3'. Likewise, in such cases where the end or guidance beams 1' are accessible from the outside (FIG. 5) the beams 1' can be connected to the panel sets 3,3' by the horizontal tie bars as is readily apparent in FIGS. 5 and 6. One can visualize, for example, the tie bars 7 being extended in FIG. 6 to clamp the beams 1,1 to both panel sets 3',3. Likewise, the tie bars 8,8' (FIG. 6) can be extended to clamp upper and lower horizontal frame shaped sections 10,11 to the respective panel sets 3,3'. In this way the tie bars 7,8 and 8' (FIG. 6) can be utilized to clamp not only the panel sets 3,3' together but also to clamp thereto both the box sections or guide beams 1,1 and the box sections 10,11.

Referring to FIG. 2 of the drawings, the upper C-shaped beam 5 is preferably closed by a sheet metal plate (unnumbered) which is welded or otherwise attached to the webs (unnumbered) of the C-shaped channel and bonded to the plate is rubber or like impact protection means 12.

In further keeping with this invention the faces (unnumbered) of the excavation supports or plates which are inboard most of an associated trench are provided by welding with vertical guidance sections or beams 13 (FIGS. 4 and 5) which receive therein in suitable conventional clamping engagement ends 14 of spreader bars which function in a conventional manner to urge pairs of the excavation panel 2 exteriorly toward the walls of an associated trench, channel or the like. If desired, conventional cutting means 15 may be mounted to the lowermost section 11 (FIGS. 2 and 6) of an associated excavation panel 2 in a known fashion, as by welding. Also, in order to increase the strength of the individual panel sets 3,3' the overall excavation support or plate 2, the interior chambers (unnumbered) of vertical beams 4 and the horizontal beams 5,6 may be filled with foam rubber, plastic or like polymeric or copolymeric material.

The latter also serves not only to strengthen the overall excavation plate but also protects the same against corrosion.

Although only a preferred embodiment of the invention has been specifically illustrated and described herein, it is to be understood that minor variations may be made in the apparatus without departing from the spirit and scope of the invention, as defined in the appended claims.

What is claimed is:

1. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, another panel formed of another plurality of contiguous generally vertically oriented beams collectively defining another plurality of side-by-side vertical chambers, another generally horizontally disposed tie bar means for connecting together said another plurality of beams, another upper generally horizontal beam and another lower generally horizontal beam spanning respective upper and lower ends of said another plurality of vertical beams, opposite endmost ones of said another plurality of vertical beams each having a vertical channel opening into its respective another chamber with said another vertical beam endmost chambers opening sidewise in opposite directions through their respective channels, said first-mentioned and another panel being in generally coplanar superposed relative relationship, and means for connecting together said first-mentioned and another panels.

2. The excavation support as defined in claim 1 including foam plastic within said chambers.

3. The excavation support as defined in claim 1 including a box-like frame formed of beams in external surrounding relationship to said upper and lower horizontal beams and said endmost vertical beams, and means for securing said frame beams to said panel.

4. The excavation support as defined in claim 1 wherein said vertical beams have aligned openings, said tie bar means pass through said openings, and terminal ends of said tie bar means are accessible through the vertical channels and chambers of said endmost vertical beams.

5. The excavation support as defined in claim 1 wherein said vertical beams have aligned openings, said tie bar means pass through said openings, and terminal ends of said tie bar means are accessible through the vertical channels and chambers of said end-most vertical beams.

6. The excavation support as defined in claim 1 wherein said upper and lower horizontal beams each includes a horizontal channel opening into a horizontal chamber with said last-mentioned chambers opening endwise in opposite directions through their respective channels, tie bar means disposed generally vertically for connecting together said upper and lower horizontal beams, said tie bar means pass through at least one of said vertical chambers, said upper and lower horizontal beams having aligned openings, said last-mentioned tie bar means pass through said openings, and terminal ends of said tie bar means are accessible through the horizontal channels and chambers of said upper and lower horizontal beams.

7. The excavation support as defined in claim 6 wherein said connecting means and said last-mentioned tie bar means are one and the same, and said last-mentioned tie bar means pass through vertical channels of both said first-mentioned and another panel.

8. The excavation support as defined in claim 7 including a box-like frame formed of beams in external surrounding relationship to said upper and lower horizontal beams and said endmost vertical beams, and means for securing said frame beams to said panel.

9. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, another panel formed of another plurality of contiguous generally vertically oriented beams collectively defining another plurality of side-by-side vertical chambers, another generally horizontally disposed tie bar means for connecting together said another plurality of beams, another upper generally horizontal beam and another lower generally horizontal beam spanning respective upper and lower ends of said another plurality of vertical beams, opposite endmost ones of said another plurality of vertical beams each having a vertical channel opening into its respective another chamber with said another vertical beam endmost chambers opening sidewise in opposite directions through their respective channels, said first-mentioned and another panel being in generally coplanar superposed relative relationship, means for connecting together said first-mentioned and another panels, and said last-mentioned connecting means is a tie bar disposed vertically relative to and connected between said first-mentioned and another panels.

10. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, another panel formed of another plurality of contiguous generally vertically oriented beams collectively defining another plurality of side-by-side vertical chambers, another generally horizontally disposed tie bar means for connecting together said another plurality of beams, another upper generally horizontal beam and another lower generally horizontal beam spanning respective upper and lower ends of said another plurality of vertical beams, opposite endmost ones of said another plurality of vertical beams each having a vertical channel opening into its respective another chamber with said another vertical beams endmost chambers opening sidewise in opposite directions through their respective channels, said first-mentioned and another panel being in generally coplanar superposed relative relationship, means for connecting together said first-mentioned and another panels, and said last-mentioned connecting means is a weld between contiguous lower and upper horizontal beams of respective uppermost and lowermost ones of said panels.

11. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, another panel formed of another plurality of contiguous generally vertically oriented beams collectively defining another plurality of side-by-side vertical chambers, another generally horizontally disposed tie bar means for connecting together said another plurality of beams, another upper generally horizontal beam and another lower generally horizontal beam spanning respective upper and lower ends of said another plurality of vertical beams, opposite endmost ones of said another plurality of vertical beams each having a vertical channel opening into its respective another chamber with said another vertical beam endmost chambers opening sidewise in opposite directions through their respective channels, said first-mentioned and another panel being in generally coplanar superposed relative relationship, means for connecting together said first-mentioned and another panels, at least one vertical guide beam adapted to have connected thereto a bracing element, and means detachably connecting said vertical guide beam to said first-mentioned and another panels.

12. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, another panel formed of another plurality of contiguous generally vertically oriented beams collectively defining another plurality of side-by-side vertical chambers, another generally horizontally disposed tie bar means for connecting together said another plurality of beams, another upper generally horizontal beam and another lower generally horizontal beam spanning respective upper and lower ends of said another plurality of vertical beams, opposite endmost ones of said another plurality of vertical beams each having a vertical channel opening into its respective another chamber with said another vertical beam endmost chambers opening sidewise in opposite directions through their respective channels, said first-mentioned and another panel being in generally coplanar superposed relative relationship, means for connecting together said first-mentioned and another panels, at least one vertical guide beam adapted to have connected thereto a bracing element, and means for detachably connecting said vertical guide beam to endmost ones of said vertical beams.

13. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, another panel formed of another plurality of contiguous generally vertically oriented beams collectively defining another plurality of side-by-side vertical chambers, another generally horizontally disposed tie bar means for connecting together said another plurality of beams, another upper generally horizontal beam and another lower generally horizontal beam spanning respective upper and lower ends of said another plurality of vertical beams opposite endmost ones of said another plurality of vertical beams each having a vertical channel opening into its respective another chamber with said another vertical beam endmost chambers opening sidewise in opposite directions through their respective channels, said first-mentioned and another panel being in generally coplanar superposed relative relationship, a vertically disposed guide beam spanning said first-mentioned and another panels for clamping engagement with a bracing element, and means for securing said guide beam to each of said first-mentioned and another panels.

14. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, said upper and lower horizontal beams each includes a horizontal channel opening into a horizontal chamber with said last-mentioned chambers opening endwise in opposite directions through their respective channels, tie bar means disposed generally vertically for connecting together said upper and lower horizontal beams, said tie bar means pass through at least one of said vertical chambers, said upper and lower horizontal beams having aligned openings, said last-mentioned tie bar means pass through said openings, and terminal ends of said tie bar means are accessible through the horizontal channels and chambers of said upper and lower horizontal beams.

15. An excavation support comprising a panel formed of a plurality of contiguous generally vertically oriented beams collectively defining a plurality of side-by-side vertical chambers, a generally horizontally disposed tie bar means for connecting together said plurality of beams, upper and lower generally horizontal beams spanning respective upper and lower ends of said plurality of vertical beams, opposite endmost ones of said vertical beams each having a vertical channel opening lengthwise into its respective chamber with said endmost chambers opening sidewise in opposite directions through their respective channels, a vertically disposed terminal end beam adjacent each endmost vertical beam, and means for detachably securing each terminal end beam to its adjacent endmost vertical beam, said upper and lower horizontal beams each includes a horizontal channel opening into a horizontal chamber with said last-mentioned chambers opening endwise in opposite directions through their respective channels, tie bar means disposed generally vertically for connecting together said upper and lower horizontal beams, said tie bar means pass through at least one of said vertical chambers, said upper and lower horizontal beams having aligned openings, said last-mentioned tie bar means pass through said openings, and terminal ends of said tie bar means are accessible through the horizontal channels and chambers of said upper and lower horizontal beams.

16. An excavation support comprising a pair of opposite generally vertically disposed and spaced end members and upper and lower opposite generally horizontally disposed and spaced end members, said pair of vertical and horizontal end members being connected together to define a generally polygonal frame setting-off an interior opening therewithin, at least one integrated filling panel within said opening, said filling panel being defined by a plurality of generally vertically disposed elements of a generally C-shaped transverse cross-sectional profile, and at least one generally horizontal tie rod means for extending transversely through and interconnecting together said C-shaped elements without connecting said filling panel to said frame, an upper generally horizontal and a lower generally horizontal elements of a generally C-shaped transverse cross-sectional profile disposed inboard of said respective upper and lower horizontally disposed end members, and another tie rod means disposed vertically for connection to said upper and lower horizontal end members.

17. The excavation support as defined in claim 16 wherein said upper and lower C-shaped horizontal elements are each defined by a bight and a pair of legs with said upper C-shaped horizontal element legs being directed upwardly and said lower C-shaped horizontal element legs being directed downwardly, and most ones of said C-shaped vertical elements each being defined by a bight and a pair of legs, and said pair of legs of said endmost C-shaped vertical elements being directed sidewise away from each other.

18. The excavation support as defined in claim 17 wherein said one horizontal tie rod means passes through said endmost vertical element bights.

19. The excavation support as defined in claim 18 including another tie rod means disposed vertically for connecting to said upper and lower horizontal end members, and said last-mentioned another tie rod means passes through said upper and lower horizontal element bights.

* * * * *